US011382428B2

(12) United States Patent
Proctor

(10) Patent No.: US 11,382,428 B2
(45) Date of Patent: Jul. 12, 2022

(54) OFFICE CHAIR SEAT AND METHOD OF MAKING SAME

(71) Applicant: ErgoGenesis Workplace Solutions, LLC, Navasota, TX (US)

(72) Inventor: Gerald L. Proctor, Bryan, TX (US)

(73) Assignee: ErgoGenesis Workplace Solutions LLC, Navasota, TX (US)

( * ) Notice: Subject to any disclaimer, the term of this patent is extended or adjusted under 35 U.S.C. 154(b) by 0 days.

(21) Appl. No.: 17/061,824

(22) Filed: Oct. 2, 2020

(65) Prior Publication Data

US 2022/0104625 A1 Apr. 7, 2022

(51) Int. Cl.

| | |
|---|---|
| ***A47C 7/02*** | (2006.01) |
| ***A47C 7/18*** | (2006.01) |
| ***B68G 7/00*** | (2006.01) |

(52) U.S. Cl.

CPC ..... *A47C 7/029* (2018.08); *A47C 7/18* (2013.01); *B68G 7/00* (2013.01)

(58) Field of Classification Search

CPC ..... A47C 7/029; A47C 7/18
USPC ..... 297/452.21–452.28
See application file for complete search history.

(56) References Cited

U.S. PATENT DOCUMENTS 1,742,186 A * 1/1930 Claus ..... A47C 7/029 5/653
3,987,507 A * 10/1976 Hall ..... A47C 7/18 5/653
4,571,763 A * 2/1986 Suzuyama ..... A47C 7/18 297/452.27
4,718,727 A * 1/1988 Sheppard ..... A47C 7/425 297/452.26
4,753,480 A * 6/1988 Morell ..... A47C 27/148 297/452.27
4,761,843 A * 8/1988 Jay ..... A61F 5/01 5/654
4,824,174 A * 4/1989 Dunn, Sr. ..... A47C 7/024 297/452.22 X
5,079,790 A * 1/1992 Pouch ..... A47C 27/148 5/630
5,282,286 A * 2/1994 MacLeish ..... A61G 5/1043 5/654
5,352,023 A * 10/1994 Jay ..... A47C 7/46 297/452.21
5,390,384 A * 2/1995 Dinsmoor, III ..... A61G 5/1045 297/452.27 X (Continued)

*Primary Examiner* — Rodney B White
(74) *Attorney, Agent, or Firm* — Hasley Scarano, L.L.P.

(57) ABSTRACT

An improved chair seat design is disclosed comprising a foam cushioning unit having top, middle, and bottom layers of foam secured together into a single unit. The bottom layer of foam includes a recess or slot sized to accommodate a void cell cushioning layer. The void cell cushioning layer is inserted into the recess/slot of the foam cushioning unit. Preferably, the void cell cushioning layer comprises an upper layer having an array of smaller cells with peaks pointing downwardly and pockets facing upwardly into the foam cushioning unit, and a lower layer having larger cells with peaks pointing upwardly and pockets facing downwardly relative to the foam cushioning unit. The foam cushioning unit with void cell cushioning layer inserted is then preferably attached to a contoured seat pan to form an improved office chair seat.

22 Claims, 5 Drawing Sheets

(56) References Cited

U.S. PATENT DOCUMENTS 5,490,299 A * 2/1996 Dinsmoor, III ..... A61G 5/1048 5/654
5,513,899 A * 5/1996 Michaels ..... A47C 31/126 297/452.25 X
5,522,106 A * 6/1996 Harrison ..... A61G 5/1045 297/452.25 X
5,687,436 A * 11/1997 Denton ..... A47C 31/126 297/452.25 X
5,836,654 A * 11/1998 DeBellis ..... A61G 5/1091 297/452.55 X
5,857,749 A * 1/1999 DeBellis ..... A61G 5/1091 297/452.25 X
6,082,824 A * 7/2000 Chow ..... A47C 9/002 297/452.22 X
6,161,238 A * 12/2000 Graebe ..... A61G 5/1043 297/452.28 X
6,241,320 B1 * 6/2001 Chew ..... A47C 7/021 297/452.26
6,687,934 B1 * 2/2004 Liao ..... A47C 7/029 297/452.26 X
6,938,290 B2 * 9/2005 McKinney ..... A47C 7/021 297/452.27
7,530,640 B2 * 5/2009 Walters ..... A47C 7/029 297/452.27 X
8,291,535 B2 * 10/2012 Kemper ..... A61G 5/1043 297/452.27 X
9,021,637 B1 * 5/2015 Whelan ..... A61G 5/1045 297/452.25 X
9,198,522 B1 * 12/2015 Wei ..... A47C 21/042
10,426,268 B1 * 10/2019 Mabon ..... A47C 7/18
2005/0017554 A1 * 1/2005 Mizelle ..... A47C 4/06 297/218.3
2009/0160236 A1 * 6/2009 Tsuber ..... A61G 5/1043 297/452.26
2015/0015042 A1 * 1/2015 Willingham ..... A47C 7/029 297/452.21 X
2016/0007671 A1 * 1/2016 Prust ..... A47C 27/007 2/411
2018/0020837 A1 * 1/2018 Cheng ..... A47C 7/18 297/452.42
2019/0045933 A1 * 2/2019 Edalati ..... A47C 7/383
2019/0125094 A1 * 5/2019 Sprouse, II ..... A47C 27/081
2020/0231285 A1 * 7/2020 Udriste ..... B60N 2/64

* cited by examiner

OFFICE CHAIR SEAT AND METHOD OF MAKING SAME

CROSS-REFERENCE TO RELATED APPLICATIONS

None.

STATEMENTS REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to chair seats. More particularly, the present invention relates to an improved office chair seat and method of making an office chair seat. Even more particularly, the present invention relates to an office chair seat and method of making the same utilizing a unique combination of a foam cushioning unit and a void cell cushioning unit.

2. Description of the Related Art

An office chair is a type of chair that is designed for use at a desk in an office or at a conference table. Modern office chairs were first developed around the mid-19th century as more workers began spending significant amounts of time sitting at a desk. Special features, such as swivel seats, wheels, and adjustable height, not generally found on other chairs were adopted to help the chair bound workers with productivity. These conventional office chairs typically included seats and backrests utilizing single or multi-density foam padding covered by cloth, leather, or the like. These types of chairs provided a deformable cushion to improve the user's comfort. As the modern requirements for office work have changed, a focus on ergonomic and comfort improvements have been developed to allow the modern worker to remain seated longer without discomfort or doing damage to the workers body, One example of an improved ergonomic office chair can be found in Applicant's U.S. Pat. No. 10,477,973, entitled "Ergonomic Chair."

The modern office has changed in many ways as many occupations have developed in which the worker is required to sit at a desk or information system for many hours. Occupations such as 911 operator, security monitors, plant operators, call center workers or dispatchers many times have jobs that are tied to sitting in an office chair for the duration of a work shift. These occupations are not only difficult for the worker, they are hard on the chair making both comfort and durability very important. To make matters worse, many times another worker replaces the first at the end of a shift using the same chair and station. This intense usage can drastically reduce the usable life of a traditional foam cushioned office chair.

Recently, a non-foam type of cushioning systems based on elastically deformable void cells have been developed and utilized in mattresses, shoe soles, military vehicles, etc. See U.S. Pat. Nos. 10,638,854, 10,624,419, and 8,714,071, respectively. As described in Skydex Technologies, Inc.'s U.S. Pat. No. 10,618,246, these void cell cushioning systems generally comprise two matrices, a first matrix of void cells having peaks, a second matrix of void cells having peaks with smaller resolutions, where it the two matrices are placed together such that the peaks of the first and second matrices are generally attached together. That is, the two matrices form a layer with both having the peaks face the interior. U.S. Pat. No. 10,618,246 is incorporated herein by reference in its entirety for all purposes including defining the background of the invention and to describe use of such systems as a component in the invention claimed herein. Other Skydex patents describing void cell cushioning systems include U.S. Pat. Nos. 10,206,517 and 10,197,125, While this cushioning system provides promising aspects in limited applications, these disclosures indicate the difficulty of application in other specific applications that require different characteristics and features.

As can now be seen, there is a genuine need to provide an improve durability and comfortable office chair seat that can combine the latest technologies in a seamless manner in order to meet the demands of the modern workplace.

BRIEF SUMMARY OF THE INVENTION

The present invention is an improved chair seat design that adds durability and comfort, and a method of making the improved chair seat. A preferred embodiment of the present invention comprises a foam cushioning unit having top, middle, and bottom layers of foam combined together into a single unit. The bottom layer of foam includes a recess or slot sized to accommodate a void cell cushioning layer. The void cell cushioning layer is inserted into the recess/slot of the foam cushioning unit. Preferably, the void cell cushioning layer comprises an upper layer having an array of smaller cells with peaks pointing downwardly and pockets facing upwardly into the foam cushioning unit, and a lower layer having larger cells with peaks pointing upwardly and pockets facing downwardly relative to the foam cushioning unit. The foam cushioning unit with void cell cushioning layer inserted is then preferably attached to a contoured seat pan to form an improved office chair seat.

Additional advantages of the invention are set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

A better understanding of the present invention can be obtained when the following detailed description of the disclosed embodiments is considered in conjunction with the following drawings in which.

DETAILED DESCRIPTION OF THE INVENTION

The present invention is an improved chair seat design that adds durability and comfort, and a method of making the improved chair seat. A preferred embodiment of the present invention comprises a foam cushioning unit having top, middle, and bottom layers of foam secured together into a single unit. The bottom layer of foam includes a recess or slot sized to accommodate a void cell cushioning layer. The void cell cushioning layer is inserted into the recess/slot of the foam cushioning unit. Preferably, the void cell cushioning layer comprises an upper layer having an array of smaller cells with peaks pointing downwardly and pockets facing upwardly into the foam cushioning unit, and a lower layer having larger cells with peaks pointing upwardly and pockets facing downwardly relative to the foam cushioning unit. The foam cushioning unit with void cell cushioning layer inserted is then preferably attached to a contoured seat pan to form an improved office chair seat.

Figures 1A, 1B:
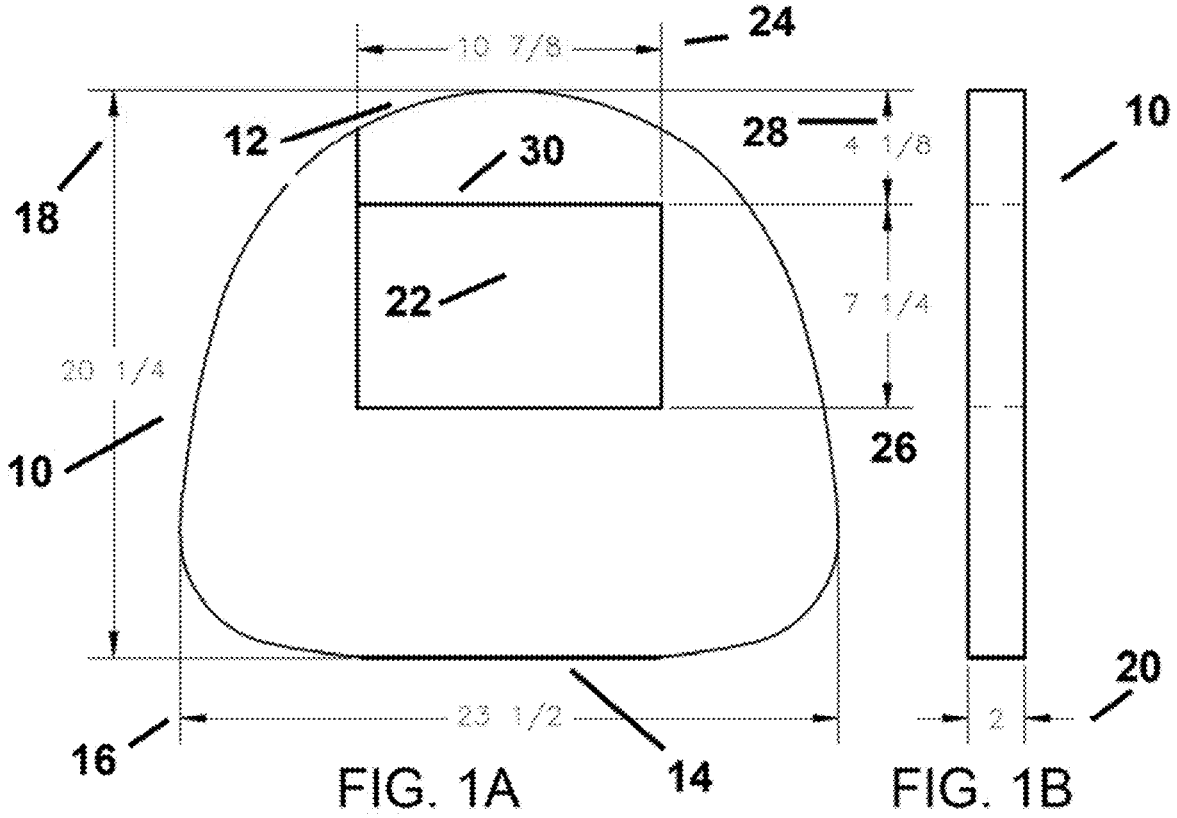
FIGS. 1A and B which are bottom and side views of an embodiment of a lower cushion segment that can be utilized in an embodiment of the chair seat.

As shown in FIGS. 1A and B, the base of the cushioning system comprises a lower cushion segment 10. Lower cushion segment 10 preferably comprises a resilient foam such as high resilience foam. As will now be recognized by a person of skill in the art, the high resilience foam utilized for lower cushion segment 10 is preferably an open-cell, flexible polyurethane foam characterized by a very fast recovery, i.e. it "bounces" back to its original shape immediately use. Alternatively, the foam could be a higher resilience viscoelastic foam. The high resilience foam supports a higher weight per cubic foot and therefore is a longer lasting foam when utilized in heavily used seat cushions. An example of an acceptable foam for lower cushion segment 10 goes by the designation HR 27545. Lower cushion segment 10 is preferably cut from pre-made foam stock but can molded into its preferred shape. As can be seen in FIG. 1, lower cushion segment 10 has a narrower, generally circular rear edge 12 and a wider forward edge 14. In general, lower cushion segment 10 should have a thickness greater than or equal to the thickness of the void cell cushioning layer 70. In the preferred embodiment, lower cushion segment 10 has a thickness 20 in the range of 3 to 1.5 inches, more preferably, in the range of 2.5 to 1.75 inches and most preferably about 2 inches. In the preferred embodiment, lower cushion segment 10 has a width 16 in the range of 20 to 26 inches, more preferably, in the range of 22.5 to 24.5 inches and most preferably about 23.5 inches. In, the preferred embodiment, lower cushion segment 10 has a depth 18 in the range of 18 to 22.5 inches, more preferably, in the range of 19.5 to 21 inches and most preferably about 20.25 inches. Although FIG. 1 represents a preferred shape for lower cushion segment 10, as will now be recognized by those skilled in the art, other shapes and dimensions can be utilized depending on the particular seating application.

Internal to lower cushion segment 10 is a generally rectangular slot 22. Slot 22 is preferably cut out of lower cushion segment 10 but can be molded in during formation. Slot 22 preferably has a width 24 in the range of 9.2725 to 12 inches, more preferably, in the range of 10.375 to 11.375 inches and most preferably about 10.875 inches. Slot 22 preferably has a depth 26 in the range of 5.75 to 8.75 inches, more preferably, in the range of 6.75 to 7.75 and most preferably about 7.25 inches. As will now be recognized by one of skill in the art, the exact shape and dimensions of slot 22 can be varied based upon the dimensions of the void cell cushioning layer. Slot 22 is generally positioned in the rear portion of lower cushion segment 10. In preferred embodiments, slot 22 is generally centered between the sides of lower cushion segment 10 and has rear edge 30 placement a distance 28 in the range of 3 to 5 inches from the rear edge 12 of the lower cushion segment 10, more preferably, in the range of 3.5 to 4.5 inches, and most preferably about 4.125 inches from the rear edge 12 of the lower cushion segment 10. As will now be recognized by one of skill in the art, slot 22 is positioned to align with the ischial tuberosity of the sitter and can be modified depending upon the design of the chair seat.

Figures 2A, 2B:
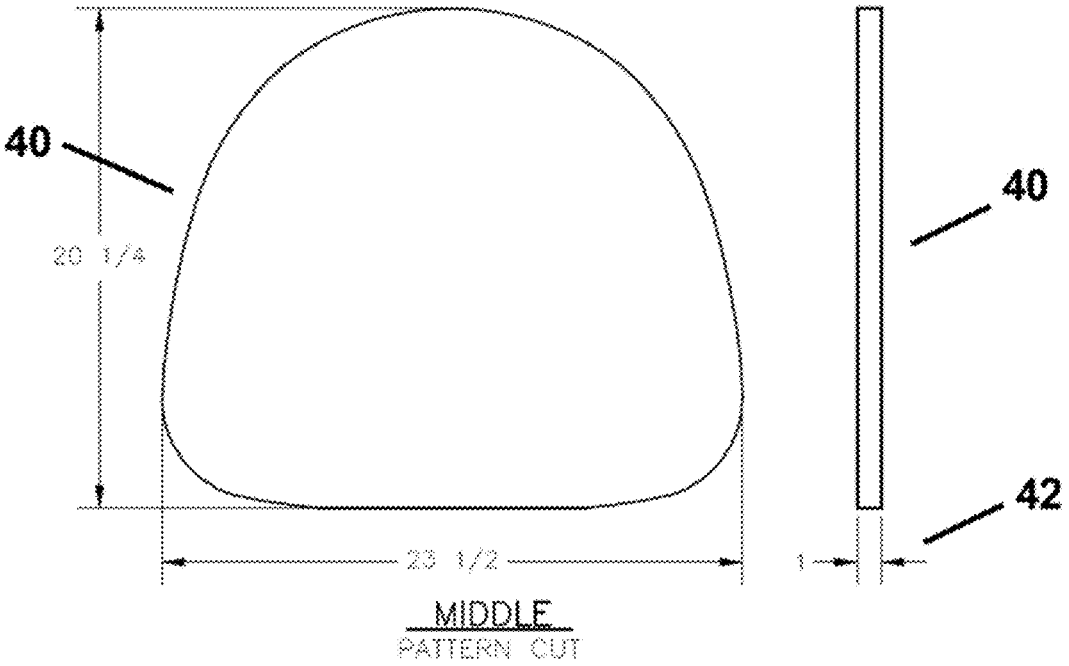
FIGS. 2A and B which are top and side views of an embodiment of a middle cushion segment that can be utilized in an embodiment of the chair seat.

As shown in FIGS. 2A and B, the next layer of the cushioning system comprises a middle cushion segment 40. In preferred embodiments middle cushion segment 40 has the generally the same shape and width and depth dimensions as the lower cushion segment 10. In the preferred embodiment, middle cushion segment 40 has a thickness 42 in the range of 0.5 to 1.5 inches, more preferably, in the range of 0.75 to 1.25 and most preferably about 1 inch. In the preferred embodiment, the middle cushion segment 40 comprises the same foam material as the lower cushion segment 10. As will now be recognized by those of skill in the art, this is not required of the invention and the two segments could have varying foams.

As a person of ordinary skill in the art will now recognize, lower cushion segment 10 and middle cushion segment 40 can be combined into a single foam unit in which middle cushion segment is the upper portion of the unit and the lower cushion segment is the lower portion of the unit. In the preferred embodiment, the lower cushion segment 10 and middle seat cushion segment are formed into two separate pieces for ease of manufacturing, and in particular for adding slot 22 in even and consistent dimensions.

Figures 3A, 3B:
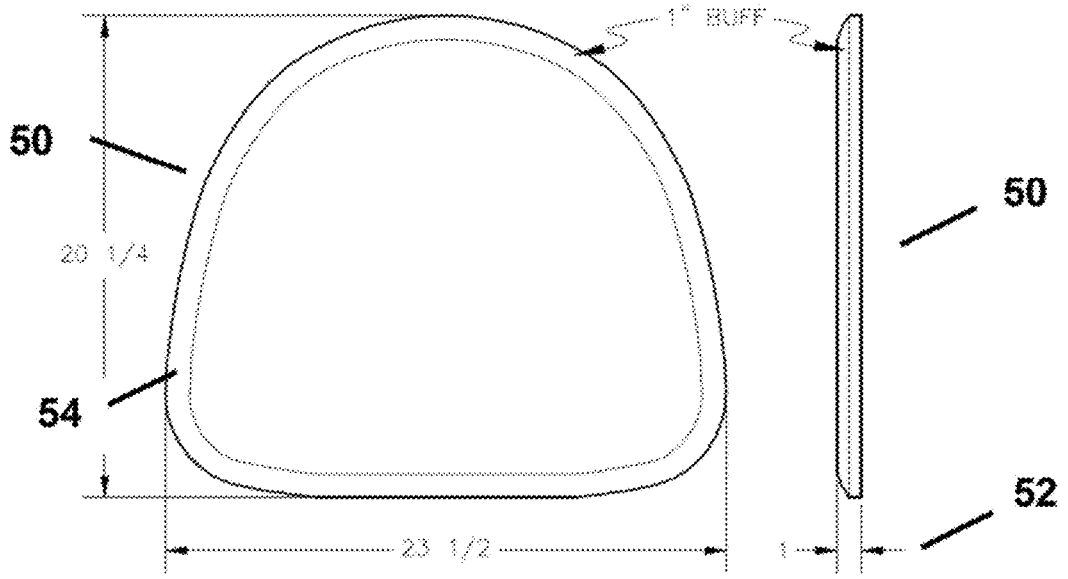
FIGS. 3A and B which are top and side view of an embodiment of a top, cushion segment that can be utilized in an embodiment of the chair seat.

As can be seen at FIGS. 3A and B, a top cushion segment 50 has generally the same shape, width and depth as lower and middle cushion segments 10 and 40. In the preferred embodiment, top cushion segment 50 has a thickness 54 in the range of 0.5 to 1.5 inches, more preferably, in the range of 0.75 to 1.25 and most preferably about 1 inches. The outside upper edges of top cushion segment 50 preferably include an about 1-inch buff 52 around the entire upper outside perimeter of the segment 50. In a preferred embodiment, top cushion segment 50 comprises a high resilience foam. Preferably, the top cushion segment comprises a somewhat softer foam that allows contouring and a lower bounce. The high reliance foam utilized in the top cushion segment 50 may be a viscoelastic foam, i.e. a memory foam, or other polyurethane blends. An example of an acceptable foam for lower cushion segment 10 goes by the designation HR 18025. While the top segment 50 is not essential and could be replaced with a larger middle segment, preferably the top segment 50 is utilized because together the segments both increase comfort and reduce seating pressure.

Figures 4A, 4B:
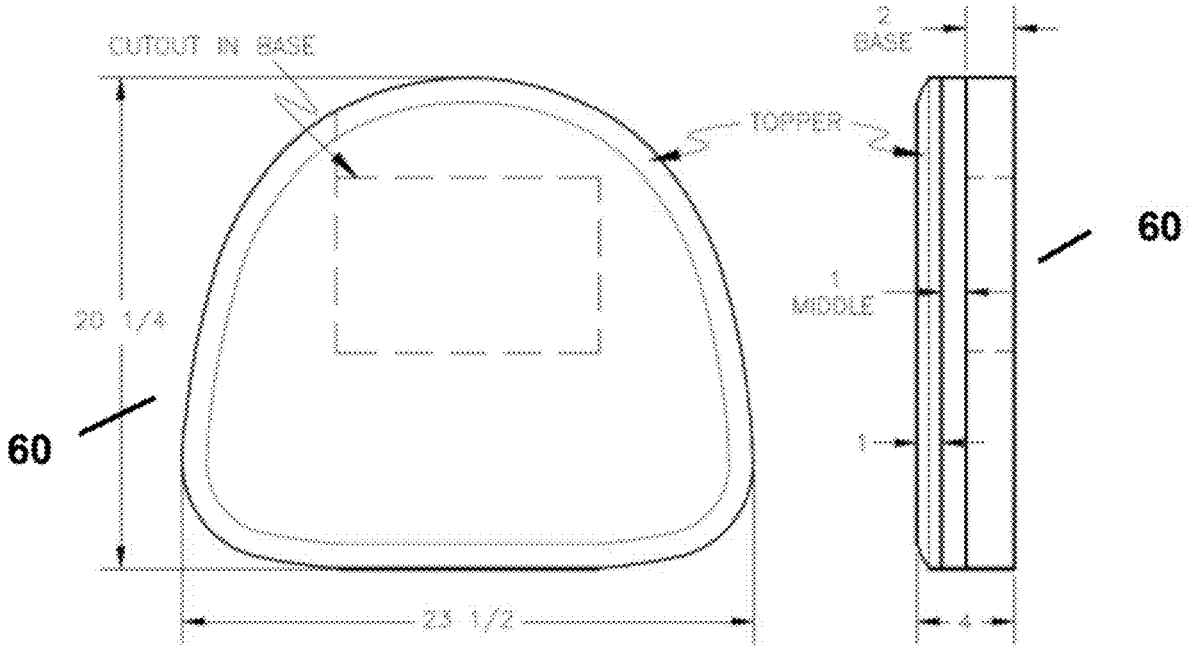
FIGS. 4A and B which are top and side views of an embodiment of a foam cushioning unit combining the segments of FIGS. 1-3 for use in an embodiment of the chair seat.

As can be seen in FIGS. 4 A and B, the lower, middle and lower cushion segments are preferably joined together to form a cushioning unit 60. In assembling cushioning unit 60, the lower surface of middle cushion segment 40 is affixed to the upper surface of lower cushioning segment 10. Next, the lower surface of top cushion segment 50 is affixed to the upper surface of middle cushion segment 40. These surfaces may be fixed together by gluing or other means of attachment such as are known to those of skill in the art.

Figure 8C:
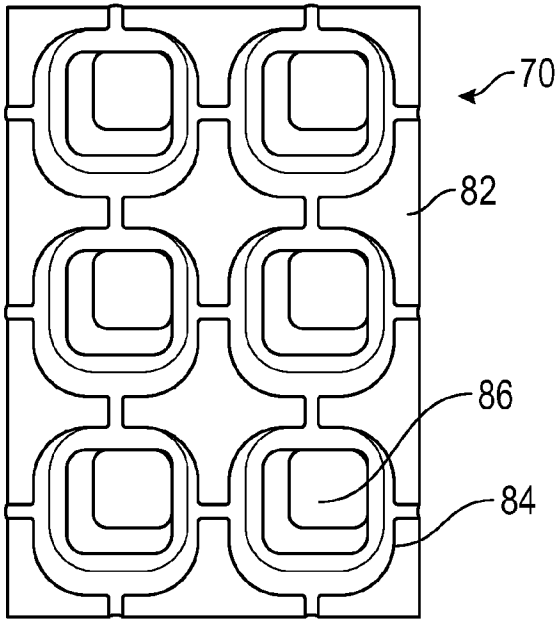
FIGS. 8A, B and C which are top, side, and bottom views, respectively, of an embodiment of a void cell cushioning layer that can be utilized in an embodiment of the chair seat.
Figure 8B:
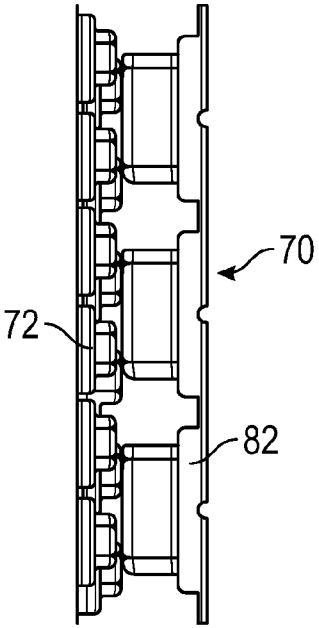
Figure 8A:
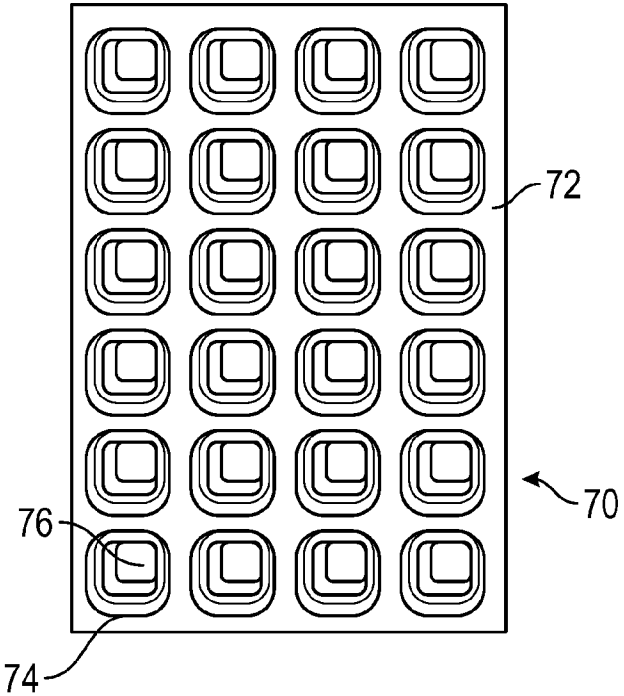

As can be seen in FIGS. 8 A, B, and C, a void cell cushioning layer 70 is utilized. As can be seen, void cell cushioning layer 70 comprises an upper layer 72 (FIG. 8A) having an array of smaller cells 74 generally pointing downwardly with the empty pocket 76 exposed on the top. In a preferred embodiment smaller cells 74 are generally rectangular in shape (with curved cornets) with an opening of about 1.5 inches by 1.5 inches. The pocket 76 on top of cells 74 is also generally rectangular having an opening of about 0.75 by 0.75 inches. The depth of the opening in cells 74 is approximately 0.75 inches including the pocket 76. Cell cushioning layer 70 further comprises an lower layer 82 (FIG. 8C) having an array of larger cells 84 generally pointing upwardly with the empty pocket 86 exposed on the bottom. In a preferred embodiment larger cells 84 are generally rectangular in shape (with curved corners) with an opening of about 3.0 inches by 3.0 inches. The pocket 86 on top of cells 84 is also generally rectangular having an opening of about 2.0 by 2.0 inches. The depth of the opening in cells 84 is approximately 1.25 inches including the pocket 86. The upper layer 72 and the lower layer 82 are attached together at the points of the cells 74 and 84, The length and width dimension of the void cell cushioning layer 70 are generally sized to accommodate the approximate size and position of sitter's ischial tuberosity or sit bones. The upper layer 72 and lower layer 82 are generally formed of elastically deformable materials and as described in U.S. Pat. No. 10,618,246 ("the '246 patent") which is incorporated by reference herein in its entirety to describe the void cell cushioning layer utilized in the claimed chair seat. Preferred embodiments of the void cell cushioning layer are available from the owner of the '246 patent, SKYDEX Technologies, Inc. of Centennial, Col.

Figure 9:
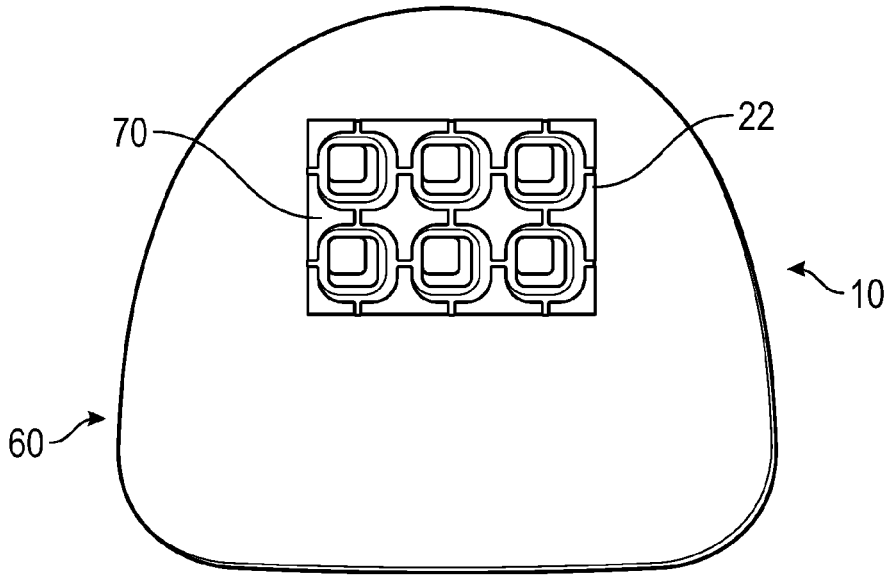
FIG. 9 is a bottom view of a foam cushioning unit with a void cell cushioning layer inserted combining the embodiments of FIGS. 4 and 8A, BC.

As can be seen in FIG. 9, once cushion unit 60 is assembled, void cell cushioning layer 70 is inserted into slot 22 on the underside of the cushioning unit 60, while cushioning unit 60 is upside down. Preferably, void cell cushioning layer 70 is inserted with upper layer 72 facing inwardly and lower layer 82 facing outwardly from slot 22. The middle cushion segment 40 and the top cushion segment 50 help to diffuse the contact area between the sitter and the void cell cushioning layer 70.

Figure 5:
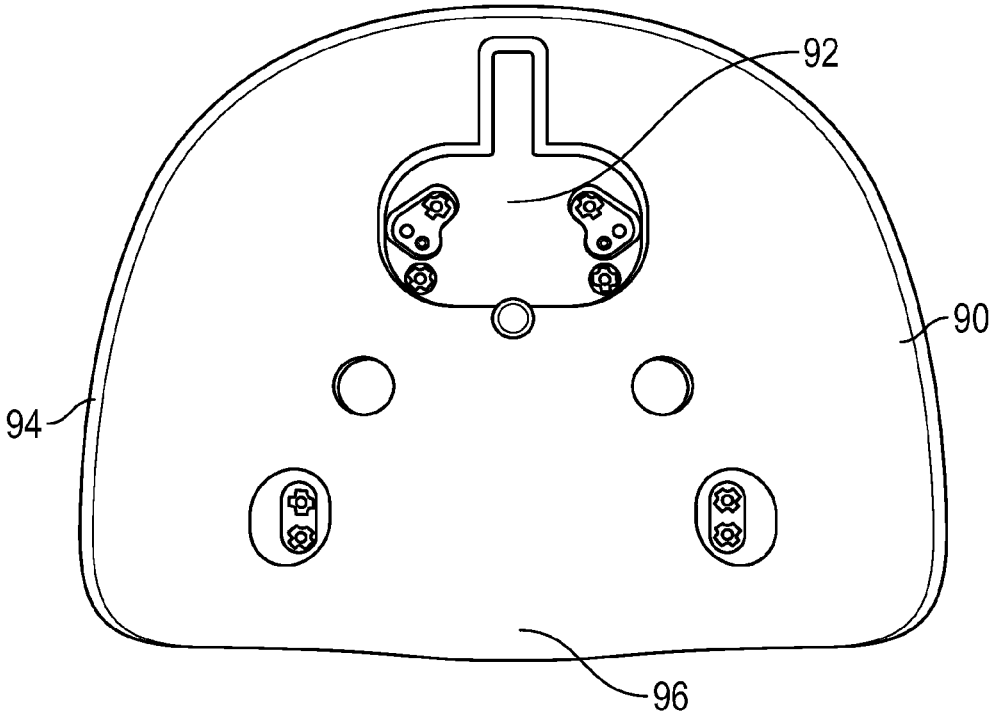
FIG. 5 is a top view of an embodiment of a contoured seat pan that can be utilized in an embodiment of the chair seat.

As can be seen in FIG. 5, the chair seat utilizes a contoured seat pan 90. As will be recognized by those skilled in the art, a contoured seat pan curves upwardly on around, the side 94 edges and in the front center 96 edge. The contoured seat pan 90 combined with cushioning unit 60 together act to spread and reduce the pressure on the sitter.

Figure 6:
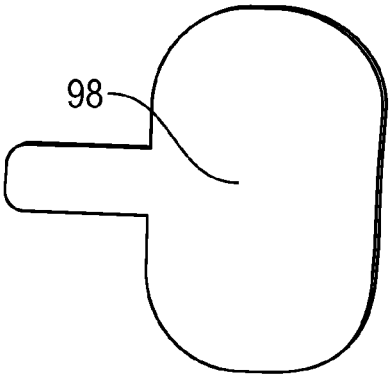
FIG. 6 is a top view of an embodiment of a support connection pad that can be utilized in an embodiment of the chair seat.
Figure 7:
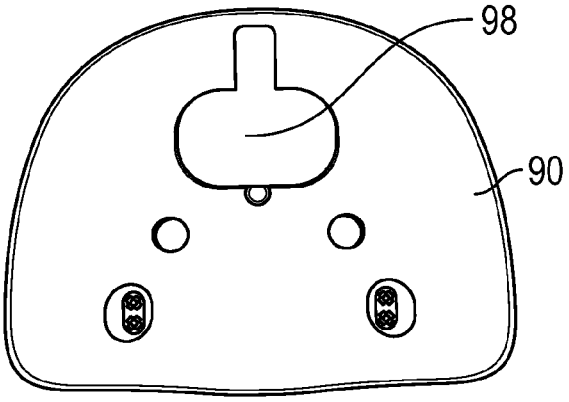
FIG. 7 is a top view of an embodiment of a padded contoured seat pan combining the embodiments of FIGS. 5 and 6 that can be utilized in an embodiment of the chair seat.

As can be seen in FIGS. 6 and 7, a support connection pad 98 (also known as an ish-dish pad) can be utilized. As can now be seen, the support connection pad 98 can be shaped to match recess 92 (FIG. 5) of contoured seat pan 90. As will be recognized by those of skill in the art, recess 92 is the location of the connection means for the seat support. Support connection pad 98 fills the void in recess 92, padding the connection and helps keeps the void cell cushioning layer 70 in place. Support connection pad 98 is preferably made of a high resilience foam, but other similar materials as are known to those skilled in the can be utilized.

As will be recognized by a person of ordinary skill in the art, the combined foam and void sell cushioning unit can then be mounted and covered in a conventional manner.

Experiments were performed comparing an embodiment of the chair seat as described with a comparable conventional chair seat. Static comfort was evaluated using an ESA pressure mapping system with a human subject sitting on the chair seats. The system mapped the seating contact and peak pressure experienced under the bony areas of the pelvis for a human subject weighing about 187 pounds. The peak pressure of the conventional chair seat was approximately 215 mmHg. The peak pressure of the embodiment of the chair seat described herein was only 88 mmHg. Earlier testing with a lighter subject reduced peak pressure from 153 mmHg in a conventional seat to 90 mmHg with for the embodiment of the chair described herein. This testing confirmed the improved comfort available with this chair seat design.

As can now be seen, an improved chair seat is disclosed that increases both comfort and durability as compared to conventional chair seats. Preferably, the improved chair seat is utilized in a heavy use office chair, but as can no be recognized, the improved chair seat could be utilized with a variety of different chair designs and still obtain the advantages of increased comfort and durability.

As can be seen from the figures, including the dimensions disclosed thereon, a person of ordinary skill in the art could now manufacture and use the disclosed chair seat. A person of ordinary skill in the art would recognize that the precise dimensions and the materials of construction for the chair seat can depend upon the chair design in which the chair seats are being utilized.

While the terms used herein are believed to be well-understood by one of ordinary skill in the art, definitions are set forth to facilitate explanation of certain of the presently-disclosed subject matter.

Following long-standing patent law convention, the terms "a", "an", and "the" refer to one or more when used in this application, including the claims. Thus, for example, reference to "a window" includes a plurality of such windows, and so forth.

Unless otherwise indicated, all numbers expressing quantities of elements, dimensions such as width and area, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of a dimension, area, percentage, etc., is meant to encompass variations of in some embodiments plus or minus 20%, in some embodiments plus or minus 10%, in some embodiments plus or minus 5%, in some embodiments plus or minus 1%, in some embodiments plus or minus 0.5%, and in some embodiments plus or minus 0.1% from the specified amount, as such variations are appropriate to perform the disclosed methods or employ the disclosed compositions.

The term "comprising", which is synonymous with "including" "containing" or "characterized by" is inclusive or open-ended and does not exclude additional, unrecited elements or method steps. "Comprising" is a term of art used in claim language which means that the named elements are essential, but other elements can be added and still form a construct within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter. With respect to the terms "comprising", "consisting of" and "consisting essentially of", where one of these three terms is used herein, the presently disclosed and claimed subject matter can include the use of either of the other two terms.

As used herein, the term "and/or" when used in the context of a listing of entities, refers to the entities being present singly or in combination. Thus, for example, the phrase "A, S, C. and/or O" includes A, S, C, and O individually, but also includes any and all combinations and subcombinations of A, S, C, and O.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. The foregoing disclosure and description are illustrative and explanatory thereof and various changes in the details of the illustrated apparatus and construction and method of operation may be made without departing from the spirit in scope of the invention which is described by the following claims.

I claim:

1. A chair seat comprising:

a void cell cushioning unit;

foam cushioning unit comprising a lower cushioning segment, a top cushioning segment, and a middle cushioning segment between said top cushioning segment and said lower cushioning segment, said lower cushioning segment comprising a slot sized to accommodate said void cell cushioning unit, and said top cushioning segment being formed from a softer foam material as compared to said lower cushioning segment;

wherein said void cell cushioning unit resides inside said slot.

2. The chair seat of claim 1 wherein said void cell cushioning unit comprises an upper void cell layer and a lower void cell layer, said lower void cell layer comprising an array of cells having a narrower pocket on top of a wider cell opening, said upper void cell layer comprising an array of cells having a narrower pocket on top of a wider cell opening; wherein said void cell cushioning unit is formed by attaching said lower void cell layer with the cell openings facing downward to said upper void cell layer with the cell openings facing upward.

3. The chair seat of claim 2 wherein said upper void cell layer is located in the slot proximate to the middle cushioning segment and said lower void cell layer opens outwardly from said slot.

4. The chair seat of claim 2 further comprising a contoured seat pan, said pan curving upwardly around edges on along said pan's side and curve upwardly at a center portion of a front side of said pan, and wherein a lower portion of said lower cushioning segment and lower void cell layer are positioned proximate to said contoured seat pan.

5. The chair seat of claim 4 wherein said contoured seat pan includes a recess for allowing connection of a seat support, said chair seat further comprising a support connection pad generally filling the recess.

6. The chair seat of claim 2 wherein the cells of said lower void cell layer are wider and deeper than the cells of said upper void cell layer.

7. The chair seat of claim 1 wherein said top cushioning segment is formed from a viscoelastic foam.

8. The chair seat of claim 1 wherein said middle cushioning segment and lower cushioning segment comprise one piece of foam.

9. The chair seat of claim 1 wherein said lower cushion segment is formed from a high resilience, open celled, polyurethane foam.

10. A chair seat comprising a void cell cushioning unit;

foam cushioning unit comprising a lower cushioning segment, said lower cushioning segment comprising a slot sized to accommodate said void cell cushioning unit;

wherein said void cell cushioning unit resides inside said slot, and wherein said slot passes completely through said lower cushion segment.

11. The chair seat of claim 10 wherein said void cell cushioning unit comprises an upper void cell layer and a lower void cell layer, said lower void cell layer comprising an array of cells having a narrower pocket on top of a wider cell opening, said upper void cell layer comprising an array of cells having a narrower pocket on top of a wider cell opening; wherein said void cell cushioning unit is formed by attaching said lower void cell layer with the cell openings facing downward to said upper void cell layer with the cell openings facing upward.

12. The chair seat of claim 11 wherein the cells of said lower void cell layer are wider and deeper than the cells of said upper void cell layer.

13. The chair seat of claim 10, further comprising a top cushioning segment, and middle cushioning segment between said top cushioning segment and said lower cushioning segment.

14. The chair seat of claim 13, wherein said middle cushioning segment and lower cushioning segment comprise one piece of foam.

15. An office chair seat comprising:

a void cell cushioning unit comprising an upper void cell layer and a lower void cell layer, said lower void cell layer comprising an array of cells having a narrower pocket on top of a wider cell opening, said upper void cell layer comprising an array of cells having a narrower pocket on top of a wider cell opening; wherein said void cell cushioning unit is formed by attaching said lower void cell layer with the cell openings facing downward to said upper void cell layer with the cell openings facing upward, and wherein the cells of said lower layer are wider and deeper than the cells of the upper layer;

foam cushioning unit comprising a lower cushioning segment, a middle cushioning segment, and a top cushioning segment, said lower cushioning segment comprising a slot sized to accommodate said void cell cushioning unit;

wherein said void cell cushioning unit resides inside said slot with said upper void cell layer proximate to said middle cushioning segment and said lower void cell layer opening outwardly from slot; and a contoured seat pan, said pan curving upwardly around edges on along said pan's side and curve upwardly at a center portion of a front side of said pan;

wherein a lower portion of said lower cushioning segment and lower void cell layer are positioned proximate to said contoured seat pan.

16. The chair seat of claim 15 wherein said lower cushion segment is formed from a high resilience, open celled, polyurethane foam.

17. The chair seat of claim 15 wherein said top cushioning segment is formed from a viscoelastic foam.

18. The chair seat of claim 15 wherein said middle cushioning segment and lower cushioning segment comprise one piece of foam.

19. The chair seat of claim 15 wherein said contoured seat pan includes a recess for allowing connection of a seat support, said chair seat further comprising a support connection pad generally filling the recess.

20. The chair seat of claim 15 wherein said lower cushion segment has a thickness of between about 1.5 and 3.0 inches.

21. The chair seat of claim 15 wherein said middle cushion segment has a thickness of between about 0.5 and 1.5 inches.

22. The chair seat of claim 15 wherein said top cushion segment has a thickness of between about 0.5 and 1.5 inches.

* * * * *